US006427999B1

(12) United States Patent
Christofferson

(10) Patent No.: US 6,427,999 B1
(45) Date of Patent: Aug. 6, 2002

(54) SIGNATURE HOPPER LOADER APPARATUS AND METHOD

(75) Inventor: David F. Christofferson, Sussex, WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 09/251,561

(22) Filed: Feb. 17, 1999

(51) Int. Cl.[7] ..... B65H 29/50; B65H 29/66
(52) U.S. Cl. ..... 271/201; 414/794.5
(58) Field of Search ..... 414/794.4, 794.5, 414/794.6; 271/198, 200, 201

(56) References Cited

U.S. PATENT DOCUMENTS

| | | | | |
|---|---|---|---|---|
| 2,715,975 A | | 8/1955 | Doane et al. | 156/521 |
| 3,674,258 A | | 7/1972 | Maier, Jr.et al. | 271/77 |
| 3,690,650 A | * | 9/1972 | Maier, Jr. et al. | 414/794.4 X |
| 3,719,267 A | | 3/1973 | Reist et al. | 198/76 |
| 3,832,938 A | * | 9/1974 | Stapp et al. | 414/794.4 X |
| 3,880,420 A | * | 4/1975 | Martin | 414/794.4 X |
| 3,894,732 A | | 7/1975 | Müller | 271/10 |
| 3,945,633 A | | 3/1976 | Knopp | 271/3.1 |
| 3,982,749 A | | 9/1976 | Stobb | 271/4 |
| 4,008,890 A | * | 2/1977 | Pulda | 414/794.4 X |
| 4,133,523 A | | 1/1979 | Berthelot | 271/182 |
| 4,279,555 A | * | 7/1981 | Rydell | 271/201 X |
| 5,026,249 A | * | 6/1991 | Shill | 414/794.4 X |
| 5,054,763 A | | 10/1991 | Achelpohl et al. | 271/182 |
| 5,197,590 A | * | 3/1993 | Prim et al. | 414/794.4 X |
| 5,249,788 A | | 10/1993 | Helmstädter | 271/10 |
| 5,282,613 A | | 2/1994 | Standerfer et al. | |
| 5,636,832 A | | 6/1997 | Honegger et al. | 271/3.21 |

FOREIGN PATENT DOCUMENTS

| | | |
|---|---|---|
| GB | 1542465 | 6/1975 |

* cited by examiner

*Primary Examiner*—Janice L. Krizek
(74) *Attorney, Agent, or Firm*—Michael Best & Friedrich LLP

(57) ABSTRACT

A signature hopper loader apparatus and method for delivering signatures in a shingled stream to the hopper.

16 Claims, 12 Drawing Sheets

SIGNATURE HOPPER LOADER APPARATUS AND METHOD

FIELD OF THE INVENTION

The present invention relates to feeding signatures to a hopper of a binding line, and more particularly, to a signature hopper loader apparatus and method for delivering signatures in a shingled stream to the hopper.

BACKGROUND OF THE INVENTION

A typical binding operation utilizes multiple hoppers or packer boxes, each of which receives signatures from a supply. The hoppers deliver signatures to a binding line on which complete books of gathered signatures are carried to a location for further processing to complete the binding process.

Signature hopper loaders are typically used to deliver signatures to the hopper. The advantages of automatically supplying signatures to the hopper, as opposed to manual loading of the hoppers, are well known. The signature hopper loaders receive a log of signatures at one end, and through a series of conveyors, deliver a shingled stream of signatures to the hopper.

SUMMARY OF THE INVENTION

The invention provides for an improved signature hopper loader apparatus for feeding signatures to a hopper of a binding line. An advantage of the present invention is the ability to feed signatures to the hopper using a minimum number of conveyor sections. The signature hopper loader preferably includes two conveyor sections. Another advantage of the signature hopper loader of the present invention is that the second conveyor section is comprised of an incline portion and a nose portion, both of which are pivotally adjustable to deliver a shingled stream of signatures horizontally to the hopper, even with variations in the height of the hopper.

It is one object of the present invention to provide an improved signature hopper loader apparatus and method for loading hoppers.

It is another object of the present invention to provide a signature hopper loader with a minimum number of conveyor sections.

It is another object of the present invention to provide a signature hopper loader with just two conveyors.

It is another object of the present invention to provide a signature hopper loader that is adjustable to deliver signatures to hoppers of varying-elevation.

It is another object of the present invention to provide an arcuate chain guide in conjunction with one of the conveyors of the signature hopper loader to aid in the shingling of the signatures.

Other features and advantages of the invention will become apparent to those of ordinary skill in the art upon review of the following detailed description, claims and drawings.

DESCRIPTION OF THE PREFERRED EMBODIMENT

Figure 1:
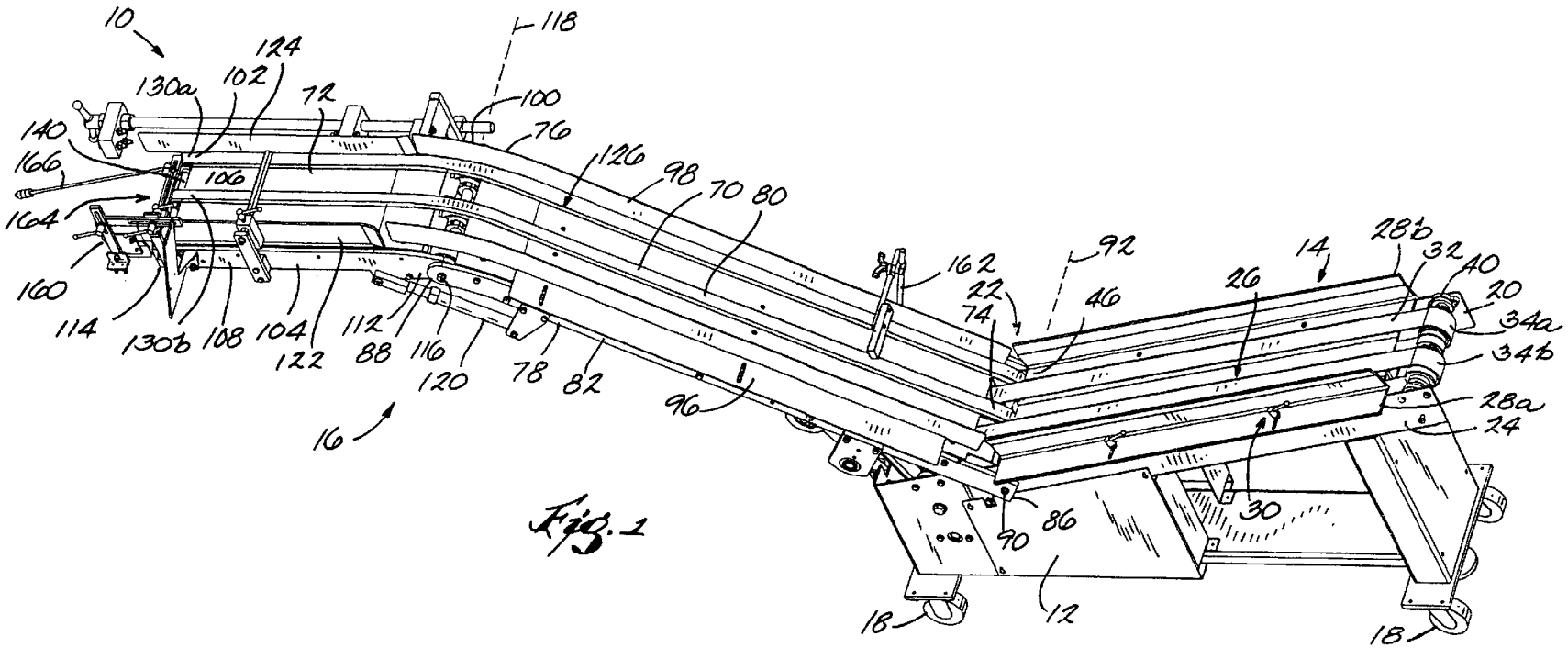
FIG. 1 is a perspective view of a signature hopper loader embodying the present invention.

Illustrated in FIGS. 1 through 4 is a signature hopper loader 10 embodying the present invention. The loader 10 generally includes a housing 12, a first conveyor assembly 14 and a second conveyor assembly 16.

The housing 12 is preferably on casters 18 that engage the floor or a support surface to enable the loader 10 to be portable to and from a desired position as needed with respect to a binding line.

The first conveyor assembly 14 is attached to the housing 12 and includes a first end 20, a second end 22, and a frame 24. The frame 24 includes a support plate 26. A pair of signature guides 28*a* and 28*b* are adjacent the edges of the support plate 26. Preferably, one of the signature guides 28*a* is laterally adjustable so as to accommodate differing sizes of signatures between the guides 28*a* and 28*b*. For example, a locking shaft and slot arrangement 30 can be employed to laterally adjust the guide 28*a*.

The first conveyor assembly 14 includes a first conveyor 32. The first conveyor 32 preferably includes two chains 34*a* and 34*b* that travel in the direction of the arrow A in FIG. 2. The chains 34*a* and 34*b* are preferably endless segmented flight conveyor chains and are preferably metal sprayed to obtain a rough top finish to provide the necessary friction to engage and move the signatures. It should be noted that a different number of chains and other conveyor materials could also be employed.

Figure 2:
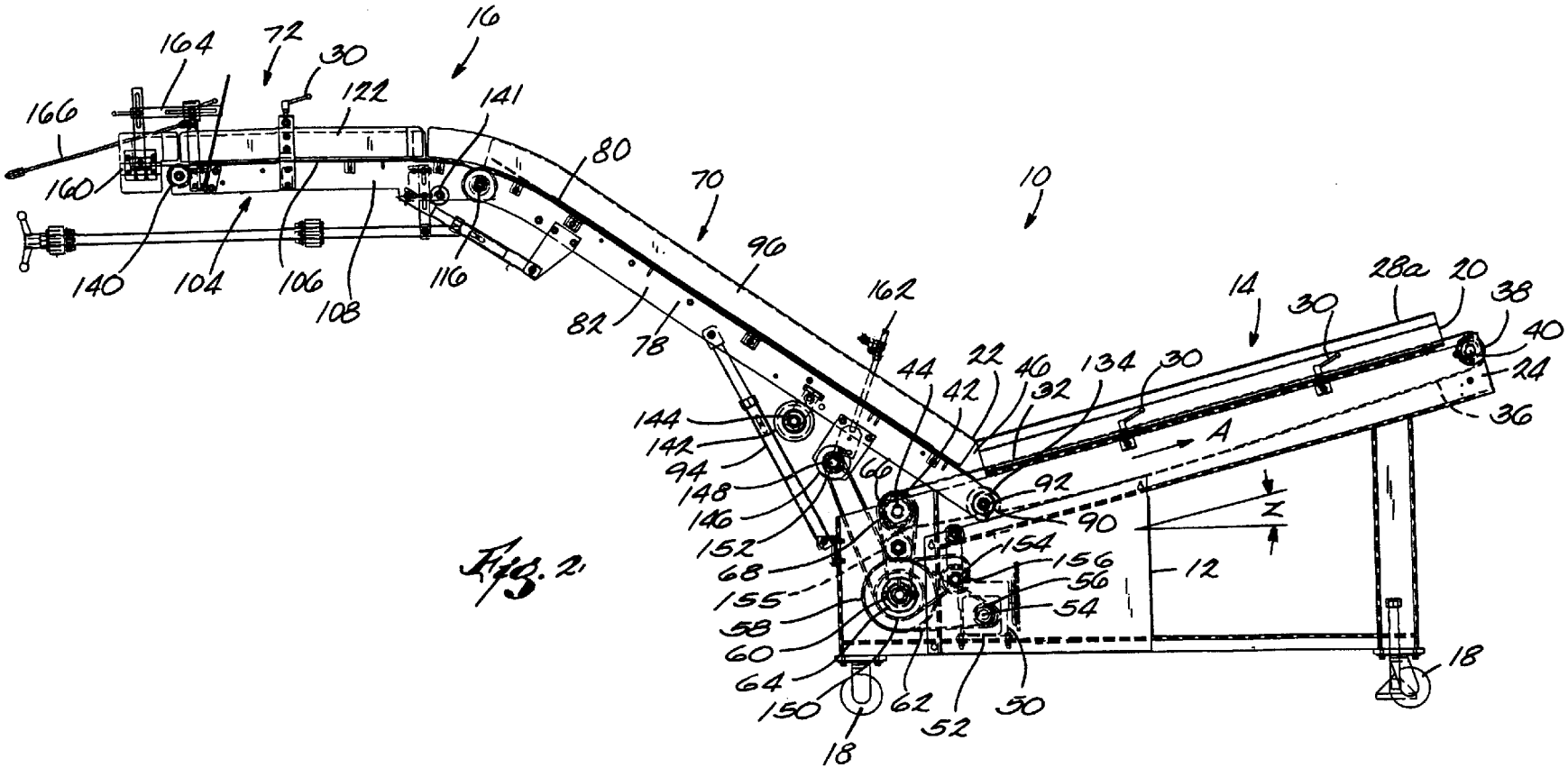
FIG. 2 is a side elevational view of the signature hopper loader.
Figure 3:
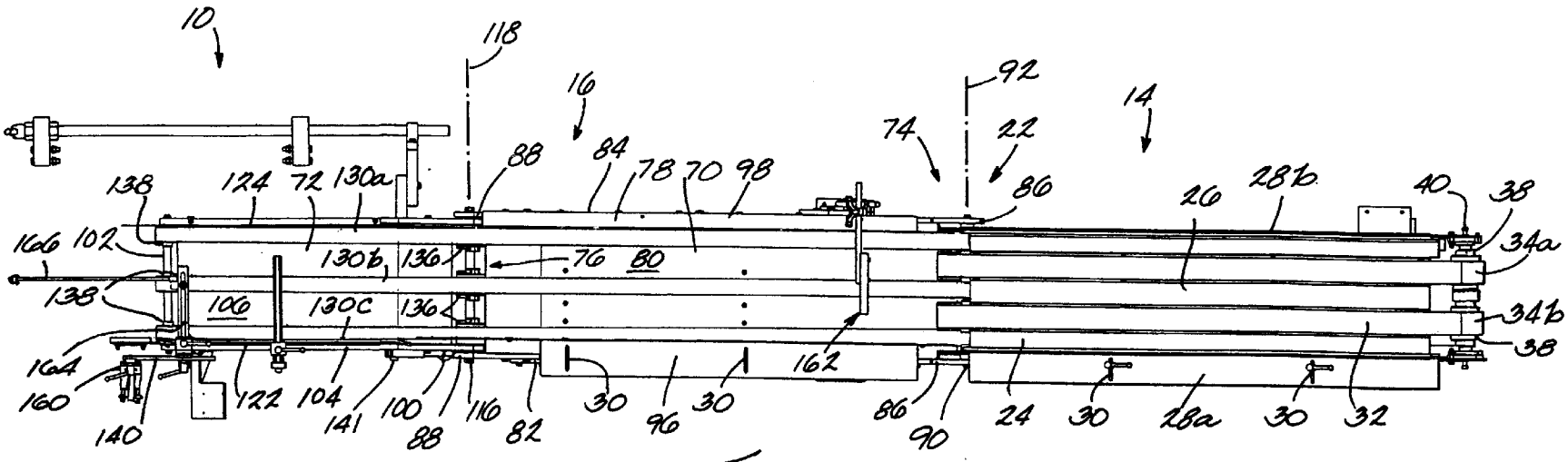
FIG. 3 is a plan view of the signature hopper loader with the belts removed.
Figure 4:
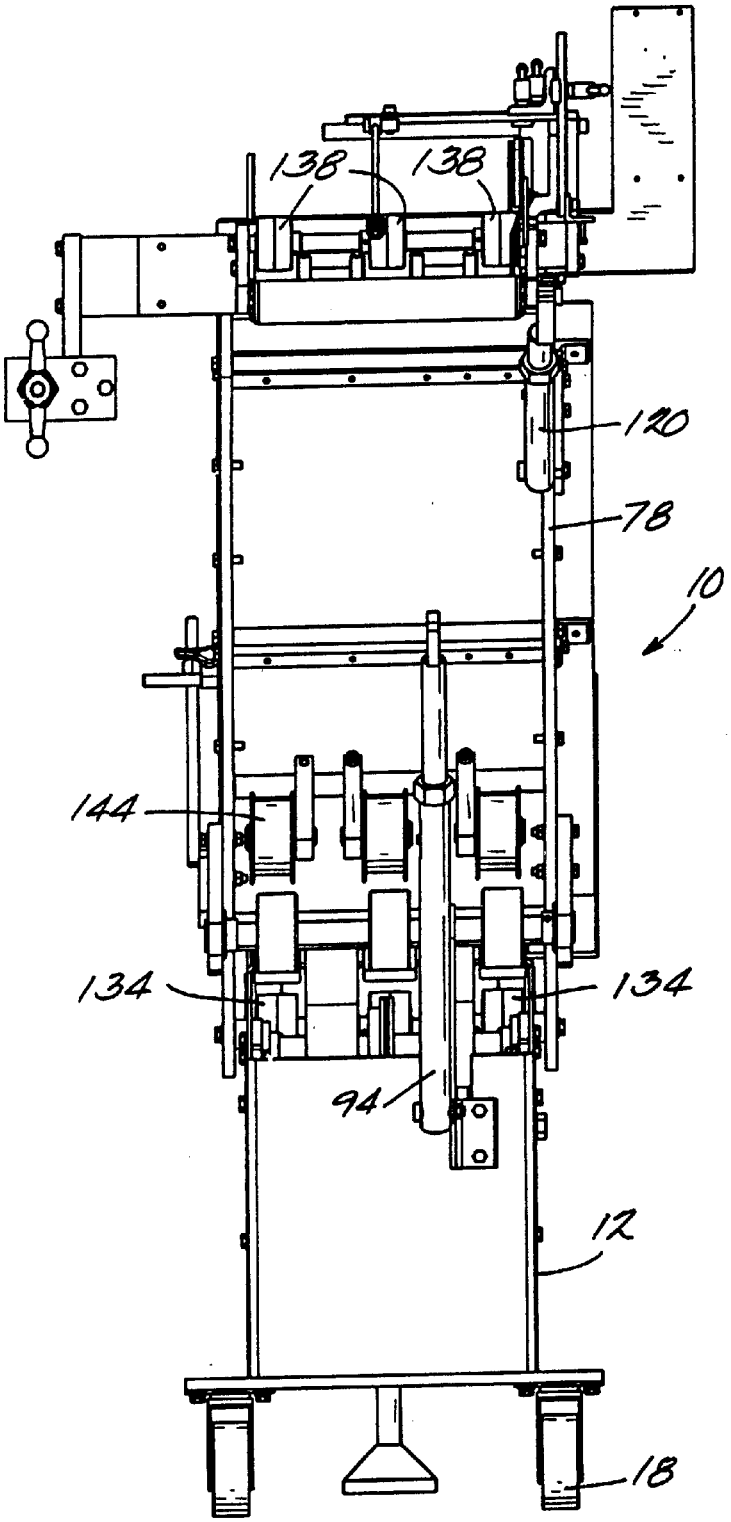
FIG. 4 is an end elevational view of the signature hopper loader.
Figure 8:
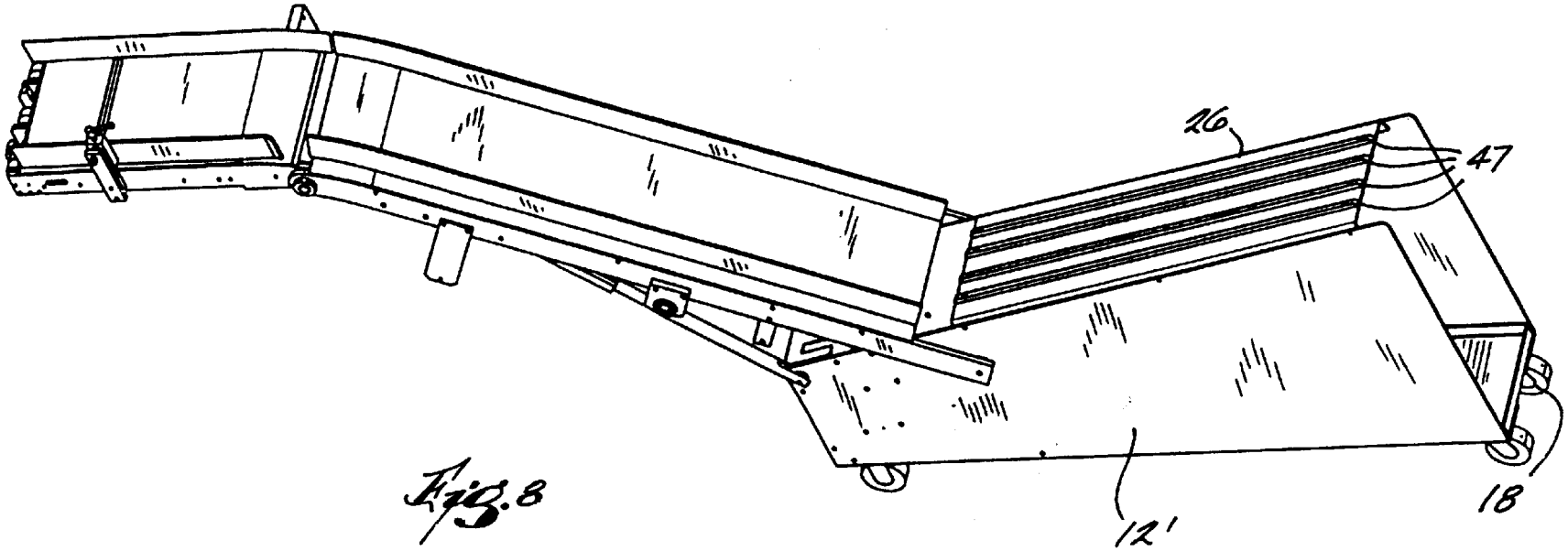
FIG. 8 is a perspective view of a frame of the signature hopper loader showing the chain guides.
Figure 9:
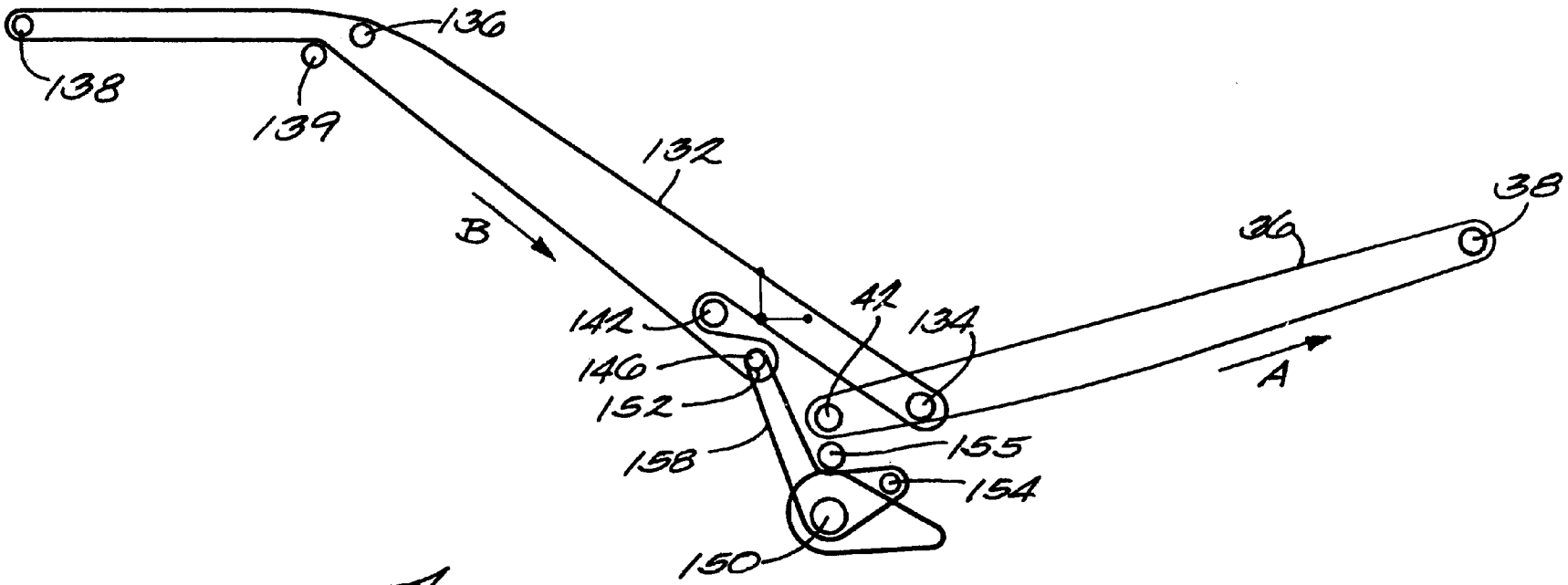
FIG. 9 is a schematic diagram of the paths of the chains and belts in the first and second conveyor assemblies.
Figure 10:
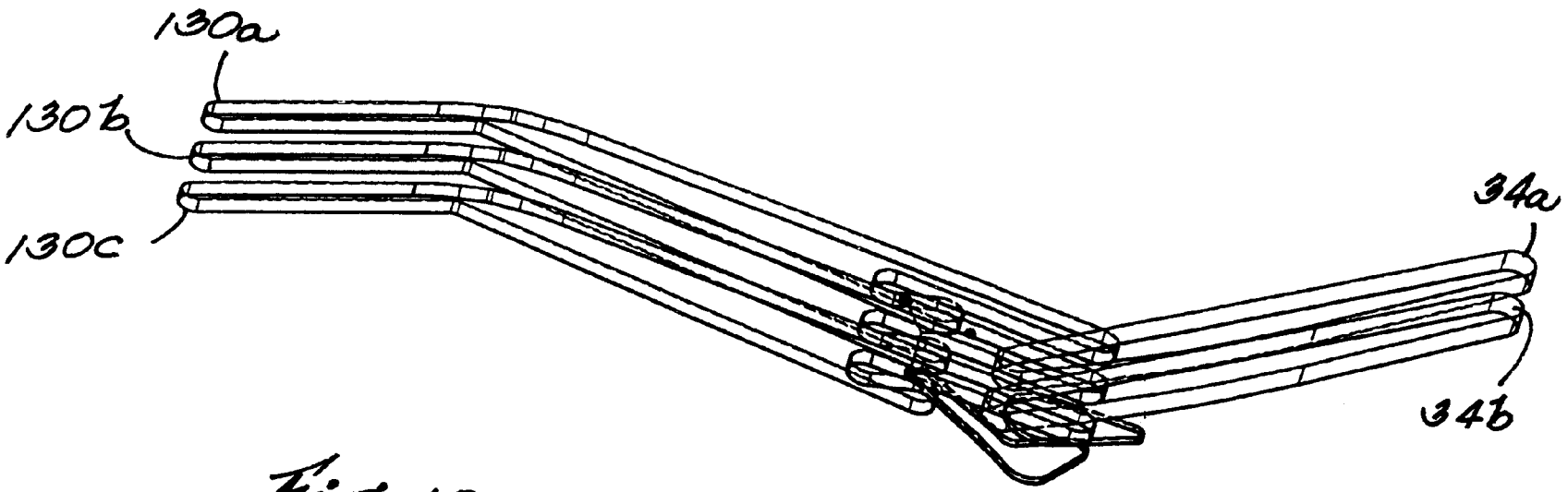
FIG. 10 is a schematic perspective view of the three belts of the second conveyor assembly and the two chains of the first conveyor assembly.

As shown in FIG. 8, two pairs of chain guides 47 are fixed to the support plate 26 and each pair guides a respective chain 34*a* or 34*b* along the support plate 26. (Note that FIG. 8 illustrates a different embodiment of the housing 12). Referring again to FIG. 2, the chains 34*a* and 34*b* are transported around corresponding rollers 38 respectively mounted on a common idler shaft 40 and rollers 42 respectively mounted on a common drive shaft 44. The chains 34*a* and 34*b* travel along an elliptical path 36, which is shown in FIGS. 2 and 9. The chains 34*a* and 34*b* receive and support a log of signatures to move the signatures in a direction generally toward the hopper. The signatures are generally in an upright position on the chains.

A drive train 50 including an AC motor 52 is used to drive the chains 34*a* and 34*b*. Specifically, the motor 52 has a rotating drive shaft 54 with a sprocket 56 thereon. Another sprocket 58 is positioned on a driven shaft 60. The sprocket 58 is larger in diameter than the sprocket 56 to thus function as a reducing gear. A chain 62 is positioned around the sprockets 56 and 58 to transmit the rotational motion of the drive shaft 54 to the driven shaft 60. A sprocket 64 is positioned on the driven shaft 60 and a sprocket 66 is positioned on the driven shaft 44. A chain 68 is positioned around the sprockets 64 and 66 to thus drive the shaft 44 and effect movement of the chains 34*a* and 34*b* in their elliptical path 36. The chains 34*a* and 34*b* travel at a first speed.

The frame 24, support plate 26, and the chains 34*a* and 34*b* are inclined relative to the horizontal at a fixed angle Z relative to the horizontal. Preferably, the angle Z is in the range of 10–25 degrees, and more preferably is 15 degrees. However, it should be noted that various other angles could also be employed. Further, a first conveyor assembly wherein the angle Z is adjustable is also contemplated. In addition, a first conveyor extension 190, such as that illustrated in FIG. 12, can be mounted adjacent to the first conveyor assembly 14 so as to accommodate a greater number of signatures. Various other conveyor extensions, such as extensions that are not horizontal, could also be employed.

Referring again to FIGS. 1–4, the second conveyor assembly 16 is mounted to the housing 12 and the first conveyor assembly 14 so as to be pivotable with respect to the first conveyor assembly 14. The first and second conveyor assemblies 14 and 16 intersect at a transition point 46 where the signatures are transferred from the first conveyor assembly 14 to the second conveyor assembly 16.

The second conveyor assembly 16 includes an incline portion 70 and a nose portion 72. The incline portion 70 has a first end 74 and a second end 76. The incline portion 70 includes a support frame 78 which includes a support plate 80 and a pair of generally parallel side plates 82 and 84. Each side plate 82 and 84 has a first end 86 and a second end 88. The first ends 86 of both side plates 82 and 84 are axially aligned. A shaft 90 extends between the aligned first ends 86 of the side plates 82 and 84. The shaft 90 defines a pivot axis 92 of the second conveyor assembly 16 relative to the first conveyor assembly 14. One of the first ends 86 of the side plates 82 and 84 is adjacent each side of the frame 24 of the first conveyor assembly 14. The shaft 90 extends between the side plates 82 and 84 through the frame 24 so as to allow the incline portion 70 to pivot about the pivot axis 92.

A strut or locking arm 94 extends between the incline portion 70 and the housing 12. The strut 94 has a locked position and an unlocked position. In the unlocked position, the strut 94 allows the incline portion 70 to pivot about the pivot axis 92 relative to the first conveyor assembly 14. In its locked position, a desired angle of the incline portion 70 relative to the first conveyor assembly 14 is maintained.

The incline portion 70 includes a pair of signature guides 96 and 98 adjacent the edges of the frame 78. Preferably, one of the signature guides 96 is laterally adjustable so as to accommodate differing sizes of signatures between the guides 96 and 98. For example, a locking shaft and slot arrangement 30 can be employed to adjust the signature guide 96.

The nose portion 72 of the second conveyor assembly 16 is adjacent the second end 76 of the incline portion 70 and is pivotally adjustable relative to the incline portion 70. The nose portion 72 includes a first end 100 and a second end 102. The nose portion 72 includes a support frame 104 which includes a support plate 106 and a pair of generally parallel side plates 108. Each side plate 108 has a first end 112 and a second end 114. The first ends 112 of each of the two side plates 108 are axially aligned with each other as well as with the second ends 88 of the side plates 82 and 84 of the incline portion 70. A shaft 116 extends between the ends 112. The shaft 116 defines a pivot axis 118 of the nose portion 72 relative to the incline portion 70.

A strut or locking arm 120 extends between the nose portion 72 and the incline portion 70. The strut 120 has a locked position and an unlocked position. In the unlocked position, the strut 120 allows the nose portion 72 to pivot relative to the incline portion 70 about the pivot axis 118. In the locked position, a desired angle of the nose portion 72 relative to the incline portion 70 can be maintained such that, with any angle of the incline portion 70 relative to the first conveyor assembly, the nose portion 72 can be maintained horizontal so as to enable the signatures to be fed to the hopper horizontally.

The nose portion 72 includes a pair of signature guides 122 and 124 adjacent the edges of the frame 104. Preferably, one of the signature guides 122 is laterally adjustable so as to accommodate differing sizes of signatures between the signature guides 122 and 124. For example, a locking shaft and slot arrangement 30 can be employed to adjust the guide 122. Each signature guide 122 and 124 is aligned with a corresponding one of the signature guides 96 and 98 of the incline portion 70 to define therebetween a travel path of the signatures.

The respective frames 78 and 104 of the incline portion 70 and the nose portion 72 support a second conveyor 126. The conveyor 126 extends from the first end 74 of the incline portion 70 to the second end 102 of the nose portion 72. The second conveyor 126, preferably, includes three belts 130*a*, 130*b*, and 130*c* which travel in the direction of the arrow B as shown in FIG. 9. The belts 130*a–c* are preferably endless belts and travel in a loop between the first end 74 of the incline portion 70 and the second end 102 of the nose portion 72. The belts 130*a–c* are preferably made of a material such as stranded polyester. It should be noted that a different number of belts and conveyors of various materials could also be utilized. The belts 130*a–c* travel along a path 132 illustrated in FIG. 9. The belts are transported around three rollers 134 respectively mounted on the common idler shaft 90 (which also serves as the pivot axis 92); three rollers 136 respectively mounted on the common idler shaft 116 (which also serves as the pivot axis 118); rollers 138 respectively mounted on a common idler shaft 140; rollers 139 respectively mounted on a common idler shaft 141; rollers 142 respectively mounted on a common idler shaft 144; and rollers 146 respectively mounted on a common driven shaft 148. The rollers 134, 136, 138, 139, 142, and 146 serve as guides for the corresponding belts 130*a–c*. Optionally, the rollers 134, 136, 138, 139, 142 and 146 may also include vertical guide plates if desired.

Each belt 130*a–c* is driven at a second speed that is preferably faster than the first speed at which the belts 34*a* and 34*b* of the first conveyor 32 are being driven. The relative speed of the first conveyor 32 and the second conveyor 126 can be varied to assist in obtaining the desired overlap of the signatures in the shingled stream.

The belts 130*a–c* of the second conveyor 126 are also driven by the drive train 50. Specifically, a sprocket 150 is mounted on the driven shaft 60. The sprocket 150 has a diameter that is larger than the diameter of the sprocket 64 also mounted on the driven shaft 60, to thus enable the belts 130*a–c* of the second conveyor 126 to be driven by the same motor 52 as the chains 34*a*, 34*b* of the first conveyor 32, but at a faster speed. A sprocket 152 is mounted on the driven shaft 148 and a sprocket 154 is mounted on an idler shaft 156. A chain 158 is positioned around the sprockets 150, 152, and 154 and idler roller 155 is used to position the chain. In this manner, the shaft 148 and therefore the belts 130*a–c* are driven.

The nose portion 72 preferably includes a jogger assembly 160 at the end 102 to align signatures before they travel to the hopper. An appropriate jogger assembly 160 is known in the art. The jogger assembly 160 illustrated is a side jogger. A so-called back jogger can also be employed to align the signatures in a direction at right angles to the direction of alignment achieved with a side jogger.

A sensor assembly 162 is mounted adjacent the transition point 46 on the incline portion 70 to monitor the movement of the signatures along the incline portion 70.

A sensor assembly 164 is mounted adjacent the nose portion 72 to control the movement of the second conveyor 126. The sensor assembly 164 is also a standard component known in the art. The sensor assembly 164 includes a sensor 166 which is designed to detect the height of the signatures in the buffer of the hopper. The sensor 166 is in operable communication with the drive train 50. When the height of the stacked signatures in the buffer of the hopper exceeds a threshold level, the sensor 166 is blocked. When blocked, the sensor 166 sends a signal to the drive train 50 so that the drive train 50 is not engaged and no signatures are delivered to the hopper. When the stacked signatures in the hopper fall below the threshold level, the sensor 166 is not blocked. When the sensor 166 is not blocked, the sensor 166 sends a signal to the drive train 50 so that the drive train 50 is energized and the signatures are delivered by the loader 10 to the hopper.

Figure 11:
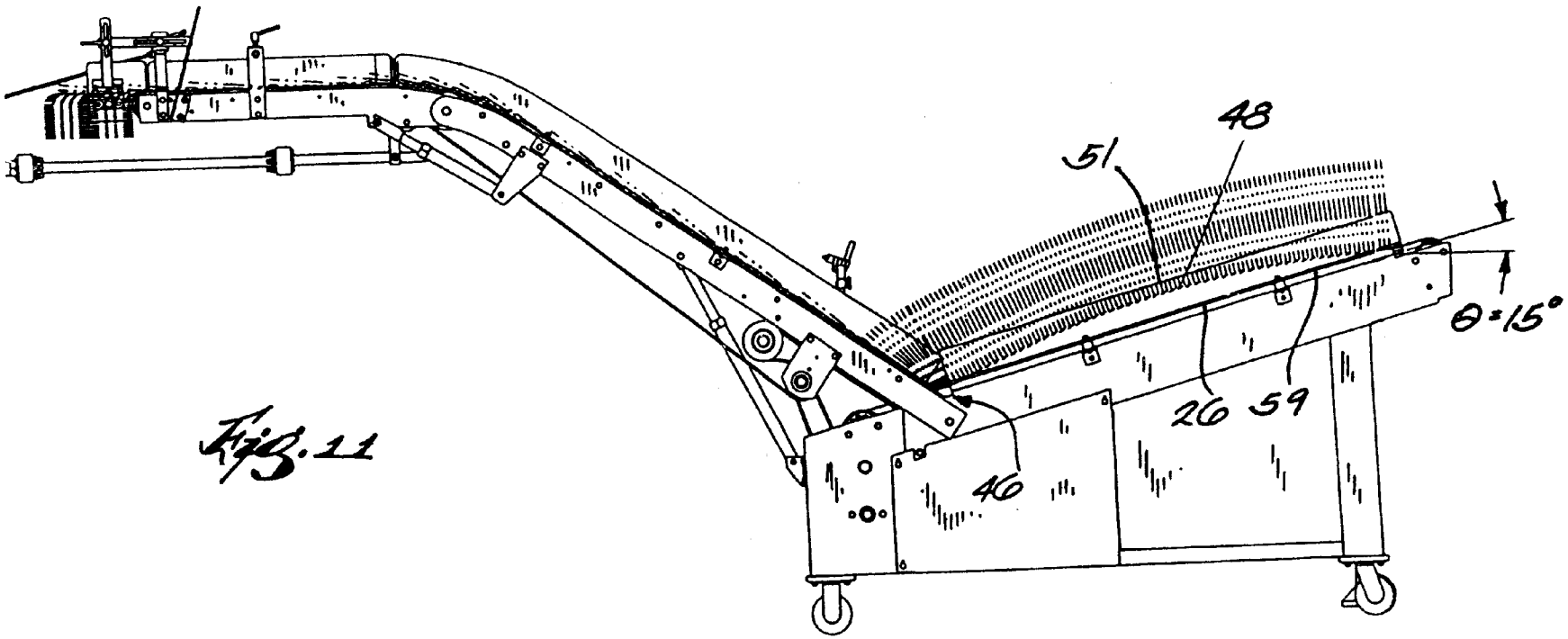
FIG. 11 is a side elevational view of the signature hopper loader using the arcuate guides for guiding the chains.

Too much signature weight on the first conveyor assembly 14 at the transition point 46 can interfere with proper shingling. By providing an arcuate or curved path for the signatures along the support plate 26, the force of the signatures at the transition point 46 is lessened. This aids in the transition of the signatures from the first conveyor assembly 14 to the second conveyor assembly 16. With reference to FIG. 11, preferably a slidable arcuate guide 48 is employed instead of the uniform height chain guides 47 shown in FIG. 8. The arcuate guides 48 guide the chains in an arcuate path along the support plate 26. The guides 48 are constructed to be approximately 1–2 inches in height at their crest 51. The guides 48 are preferably constructed of an ultra high molecular weight (UHMW) plastic and are fastened to the support plate 26 by any known means.

In operation, as the signatures pass the crest 51, the signatures are slightly broken apart. The arcuate guides 48 also help reduce the amount of signature weight at the transition point 46, because a portion of the signature weight of the entire log of signatures is distributed on the front portion 59 of the support plate 26.

Alternately, the guides 48 can be made to have any length less than the length of the first conveyor 32, and can be adjustably positioned along the support plate at a number of positions. Allowing the arcuate guides 48 to be adjustable in position allows a shift in the weight distribution of the log of signatures as desired. This is important because the weight of a log of signatures can vary significantly depending on the type and weight of paper used for the signatures.

Figure 5:
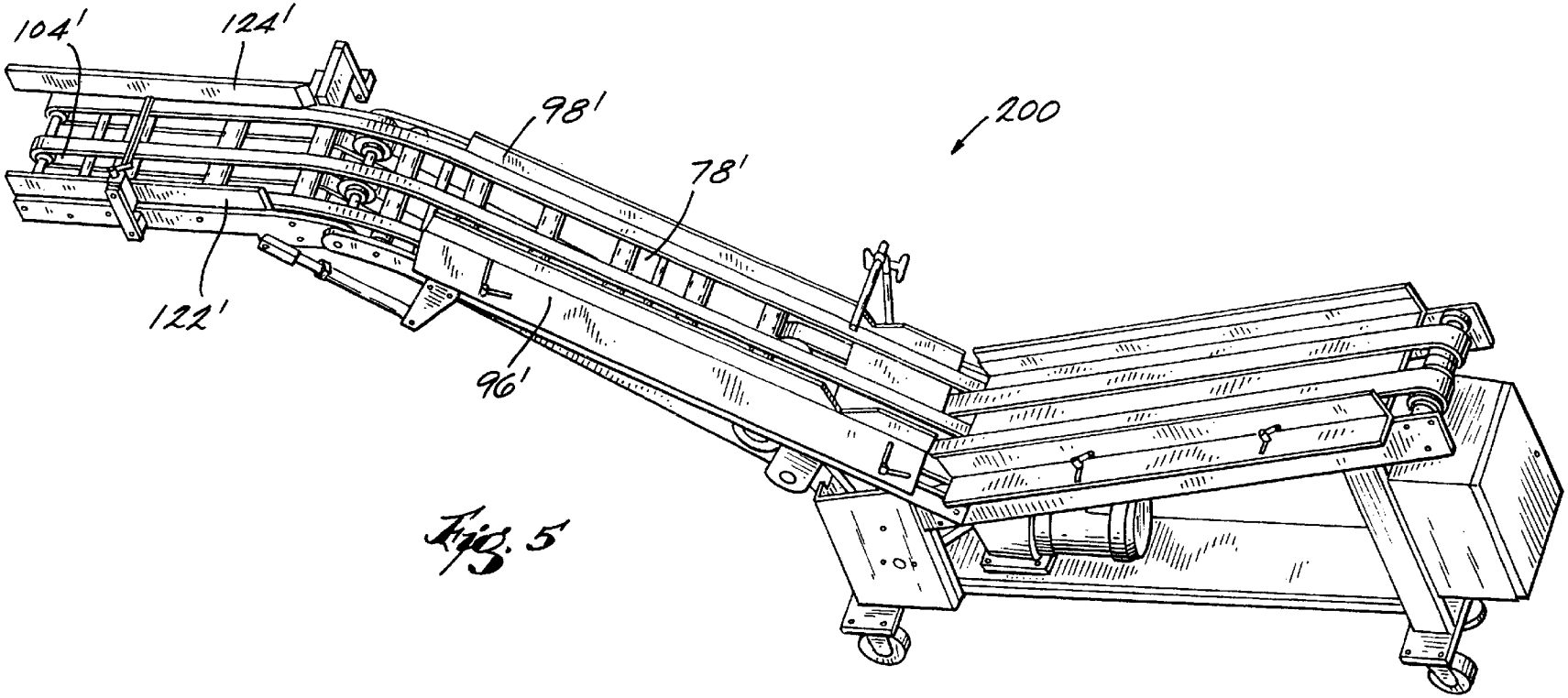
FIG. 5 is a perspective view of a hopper loader embodying the invention.

Referring to FIG. 5, a second embodiment 200 of the hopper loader of the present invention is shown wherein like reference numerals refer to the elements relative to loader 10, as explained above. The loader 200 differs from loader 10 in the configuration of the signature guides 96', 98', 122', and 124', and the frames 78' and 104'.

Figure 6:
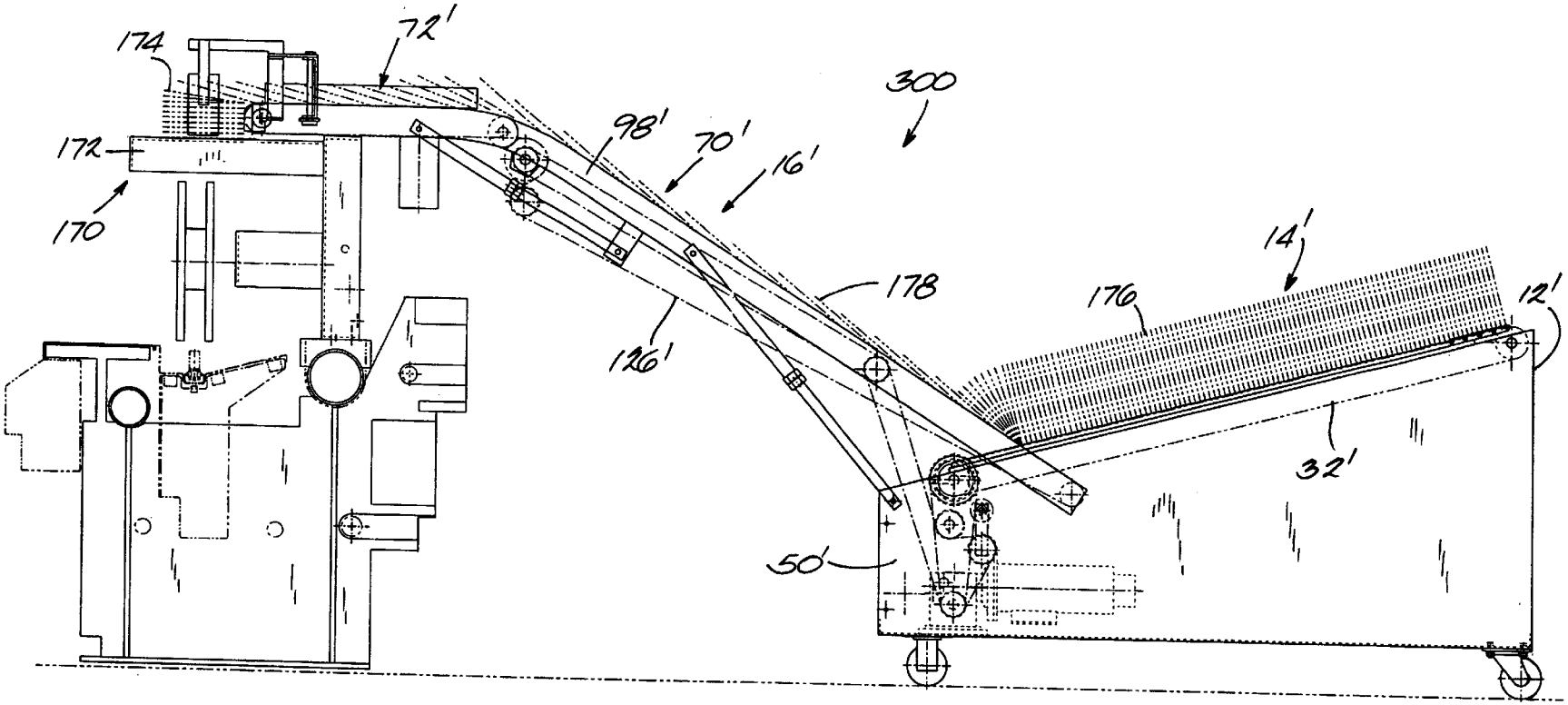
FIG. 6 is a side elevational view of a signature hopper loader embodying the present invention shown with signatures thereon and shown in conjunction with a hopper.

Referring to FIG. 6, a third embodiment 300 of the signature loader is shown, wherein like reference numerals refer to like elements relative to the loader 10. The loader 300 differs from the loader 10 in the configuration of the housing 12', the incline portion 70' and the nose portion 72', the drive train 50' for the conveyors 32' and 126', and the signature guides 98' of the incline section 70'. As with the loader 10, the loader 300 includes only two conveyor assemblies 14' and 16', with the second conveyor assembly 16' having an incline portion 70' and a nose portion 72'.

Figure 7:
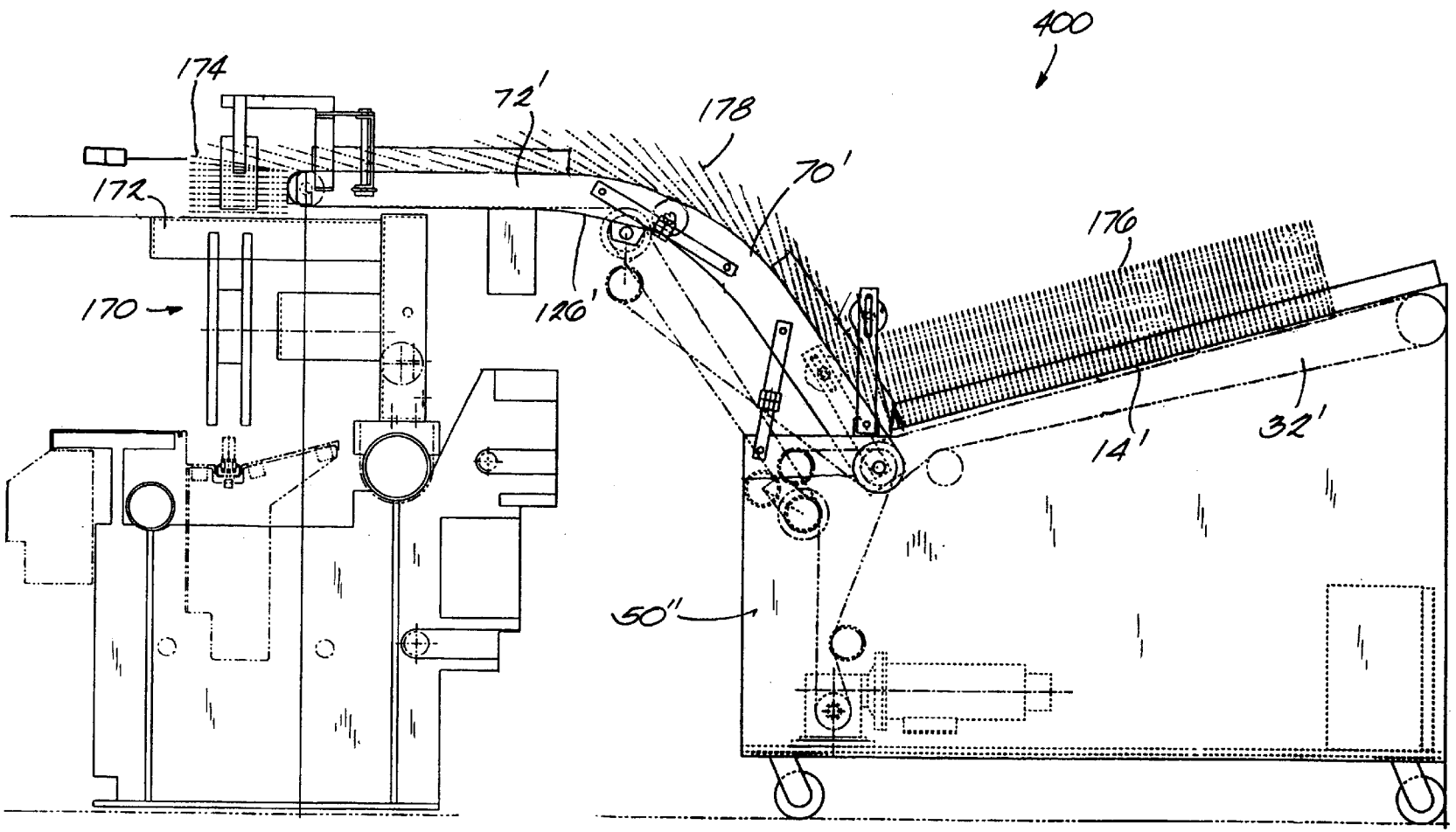
FIG. 7 is a side elevational view of a signature hopper loader embodying the invention shown with signatures thereon and shown in conjunction with a hopper.

Referring to FIG. 7, a fourth embodiment 400 of the signature loader is shown, wherein like reference numerals refer to like elements relative to the loader 10. The loader 400 differs from the loader 10 in the configuration and length of the incline portion 70' and the length of the incline portion 70' relative to the nose portion 72'. The loader 400 further employs a different drive train 50" configuration for the conveyors 32' and 126'.

As is shown in FIGS. 6 and 7, the loader of the present invention is operated in conjunction with a conventional hopper 170 or packer box of a binding operation. The hopper 170 includes a feedrack 172 into which the shingled stream of signatures is fed from the nose section 72 of the loader to form a buffer 174.

The signature loader of the present invention is operable as follows. The signature guide 28*a* of the first conveyor assembly 14 as well as the signature guides 96 and 122 of the second conveyor assembly 16 are adjusted to approximate the width of the signatures to be fed by the loader to the hopper 170. The second conveyor assembly 16 is adjusted to accommodate the height of the hopper 170 to which the loader is to feed signatures. The incline portion 70 is adjusted using the strut 94, and the nose portion 72 is leveled using the strut 120. In this way, the loader can be adjusted such that the nose portion 72 delivers a shingled stream of signatures horizontally to the buffer 174 of the hopper 170 to accommodate differing elevations of hoppers.

Figure 12:
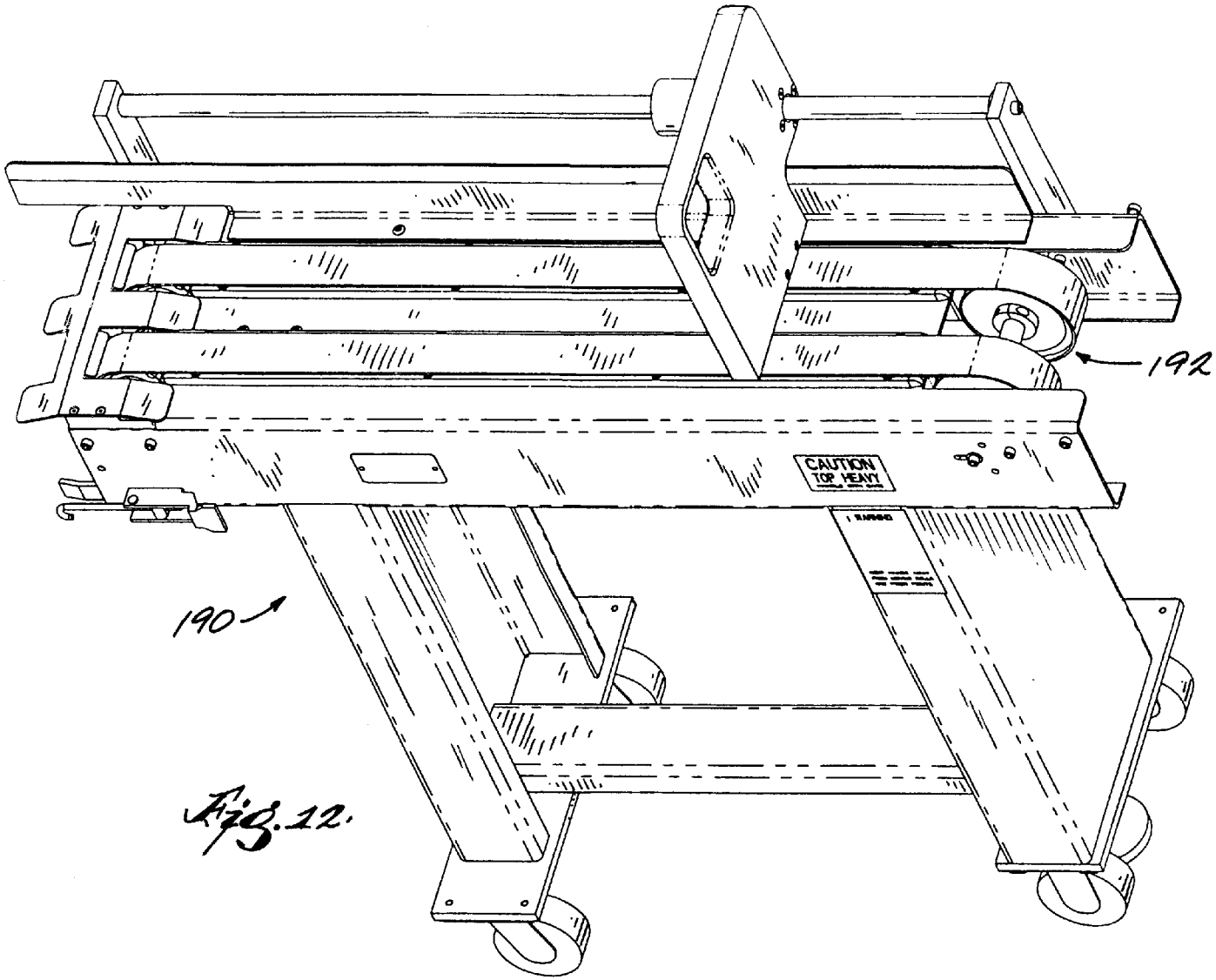
FIG. 12 is a perspective view of an extension for the signature hopper loader.

As shown in the embodiments of FIGS. 6 and 7, a log of signatures 176 is placed upon the chains 34*a–b* of the first conveyor by an operator. If needed, an extension 190 as shown in FIG. 12 can be attached to the housing 12 or frame 24 to accommodate a larger number of signatures. The extension 190 provides a generally horizontal conveyor 192, and may be adjustable in height to match the height of the first conveyor assembly 14.

The signatures are transferred from the first conveyor 32 to the second conveyor 126 at the transition point 46. Because the belts 130*a–c* of the second conveyor 126 are traveling at a speed faster than the chains 34*a–b* of the first conveyor, the signatures form a shingled stream 178 on the incline portion 70. The belts 130*a–c* transfer the shingled stream of signatures from the incline portion 70 to the nose portion 72, then to the end 102 of the nose portion 72. The jogger assembly 160 insures that the shingled stream of signatures is aligned.

When the feedrack 172 of the hopper 170 needs to have signatures delivered to it, the drive train 50 is energized causing the chains 34*a–b* to travel along path 36 and causing the signatures to move along the first conveyor 32. From the first conveyor 32, the signatures move along the incline portion 70 and nose portion 92 of the second conveyor 126 until the signatures stack and form the buffer 174 in the hopper 170, at which time the sensor 166 is blocked. When the sensor 166 is blocked, the sensor 166 sends a signal to the drive train to cause the chains 34*a–b* and belts 130*a–c* to cease movement.

When the binding line is operating, the buffer 174 is lowered into the feedrack 172 which clears the sensor 166. The sensor 166 then sends a signal to the drive train 50 causing the chains 34*a–b* and belts 130*a–c* to move and thus again form the buffer 174 of signatures until the sensor 166 becomes blocked and the process repeats itself.

It should be noted that the lengths of the conveyor assemblies 14 and 16, and conveyors 32 and 126 in particular, can be adjusted as desired to accommodate varying amounts and sizes of signatures.

It is understood that the invention is not confined to the particular construction and arrangement of parts herein illustrated and described, but embraces all such modified forms thereof as may come within the scope of the following claims. It will be apparent that many modifications and variations are possible in light of the above teachings. It therefore is to be understood that within the scope of the appended claims, the invention may be practiced other than is specifically described. Alternative embodiments and variations of the method taught in the present specification may suggest themselves to those skilled in the art upon reading of the above description. Various other features and advantages of the invention are set forth in the following claims.

What is claimed is:

1. A hopper loader for feeding a plurality of signatures to a hopper of a binding line, the hopper loader comprising:

a first conveyor assembly including a first conveyor for supporting and moving the signatures generally toward the hopper, and a second conveyor assembly connected to the first conveyor assembly, the second conveyor assembly including a second conveyor for receiving the signatures from the first conveyor and supporting and moving the signatures to the hopper, the second conveyor assembly further including an incline portion and a nose portion, wherein the incline portion is pivotably conjoined to the first conveyor assembly and the nose portion is pivotably connected to the incline portion in order to feed signatures horizontally to the hopper, regardless of the height of the hopper, and wherein the nose portion and the incline portion include a common belt traveling in an endless loop.

2. A hopper loader as recited in claim 1 wherein the incline portion includes a frame and the nose portion includes a frame and wherein both frames support the second conveyor.

3. A hopper loader as recited in claim 1 wherein the first conveyor is fixed in an inclined position relative to the horizontal.

4. A hopper loader as recited in claim 1 wherein the first conveyor moves the signatures along an arcuate path.

5. A hopper loader as recited in claim 1 further including a drive train having a motor to move the first conveyor at a first speed and the second conveyor at a second speed that is greater than first speed.

6. A hopper loader as recited in claim 1 further including signature guides laterally adjustable so as to accommodate differing sizes of signatures.

7. A hopper loader as recited in claim 1 wherein the first conveyor has a first end and a second end, the incline portion has a first end and a second end, and the nose portion has a first end and a second end, and wherein the first end of incline portion connects to the second end of the first conveyor and the first end of the nose portion connects to the second end of the incline portion.

8. A hopper loader as recited in claim 1 wherein the second conveyor includes three belts traveling in endless loops.

9. A hopper loader as recited in claim 1 wherein the incline portion includes a locking arm attached to the housing for pivotably adjusting the incline portion relative to the first conveyor assembly.

10. A hopper loader as recited in claim 9 wherein the nose portion includes a second arm attached to the incline portion for pivotably adjusting the nose portion relative to the incline portion.

11. A hopper loader as recited in claim 1 wherein the first conveyor includes a chain and a chain guide for guiding the chain.

12. A hopper loader as recited in claim 11 wherein the chain guide is arcuate and the signatures move in an arcuate path on the first conveyor.

13. A hopper loader as recited in claim 11 wherein the chain is an endless segmented flight conveyor chain.

14. A hopper loader as recited in claim 11 wherein the first conveyor assembly further includes a support plate, and the chain circulates around a portion of the support plate.

15. A hopper loader for feeding a plurality of signatures to a hopper of a binding line, the hopper loader comprising:

a first conveyor assembly including a first conveyor fixed in an inclined position relative to the horizontal for supporting and moving the signatures generally toward the hopper, the first conveyor assembly further including a curved guide for guiding the first conveyor along an arcuate path, and a second conveyor assembly connected to the first conveyor assembly, the second conveyor assembly including a second conveyor for receiving the signatures from the first conveyor and supporting and moving the signatures to the hopper, the second conveyor assembly further including an incline portion having a frame and a nose portion having a frame, wherein both frames support the second conveyor, and wherein the incline portion is pivotably connected to the first conveyor assembly and the nose portion is pivotably connected to the incline portion in order to feed signatures horizontally to the hopper, regardless of the height of the hopper.

16. A hopper loader for feeding a plurality of signatures to a hopper of a binding line, the hopper loader comprising:

a first conveyor assembly including a first conveyor for supporting and moving the signatures generally toward the hopper, wherein the first conveyor includes a chain and an arcuate chain guide for guiding the chain such that the signatures move in an arcuate path on the first conveyor; and a second conveyor assembly connected to the first conveyor assembly, the second conveyor assembly including a second conveyor for receiving the signatures from the first conveyor and supporting and moving the signatures to the hopper, the second conveyor assembly further including an incline portion and a nose portion, wherein the incline portion is pivotably adjustable with respect to the first conveyor assembly and the nose portion is pivotably adjustable with respect to the incline portion in order to feed signatures horizontally to the hopper, regardless of the height of the hopper.

* * * * *